United States Patent [19]

Jeschke

[11] Patent Number: 5,029,525

[45] Date of Patent: Jul. 9, 1991

[54] SHEET-FED OFFSET AND PRINTING MACHINE HAVING A CHAIN DELIVERY AND CONSOLE

[75] Inventor: Willi Jeschke, Heidelberg, Fed. Rep. of Germany

[73] Assignee: Heidelberger Druckmaschinen Ag, Heidelberg, Fed. Rep. of Germany

[21] Appl. No.: 513,033

[22] Filed: Apr. 23, 1990

Related U.S. Application Data

[63] Continuation of Ser. No. 215,216, Jul. 5, 1988, abandoned, which is a continuation-in-part of Ser. No. 120,860, Nov. 16, 1987, abandoned, which is a continuation-in-part of Ser. No. 903,664, Sep. 4, 1986, abandoned.

[30] Foreign Application Priority Data

Sep. 4, 1985 [DE] Fed. Rep. of Germany ..... 3531523
Apr. 10, 1986 [DE] Fed. Rep. of Germany ..... 3612067

[51] Int. Cl.[5] ..... B41F 5/06; B41F 13/00; B41F 1/56

[52] U.S. Cl. ..... 101/232; 101/DIG. 45

[58] Field of Search ..... 101/232, 216, 236, 237–240, 101/365, 283, 212, DIG. 45, DIG. 47; 250/559, 571; 364/526, 525; 356/443, 444, 445, 380

[56] References Cited

U.S. PATENT DOCUMENTS 3,907,274 9/1975 D'Amato et al. ..... 101/232

FOREIGN PATENT DOCUMENTS 0062168 3/1982 European Pat. Off. ..... 101/232
2000082 1/1979 United Kingdom ..... 101/365

*Primary Examiner*—J. Reed Fisher
*Attorney, Agent, or Firm*—Herbert L. Lerner; Laurence A. Greenberg

[57] ABSTRACT

Sheet-fed offset printing machine including a chain delivery and a control console assigned to the chain delivery and including a remote-control device and a sheet deposit structure for controlling quality of a freshly printed sheet during operation of the printing machine, the control console being actuable for effecting a test sheet withdrawal, the control console with the sheet deposit structure being arranged directly at an end of the chain delivery, as viewed in sheet travel direction, the sheet deposit structure being disposed below a sheet conveying path and a test-sheet outlet, respectively, as an extension of the chain delivery.

12 Claims, 8 Drawing Sheets

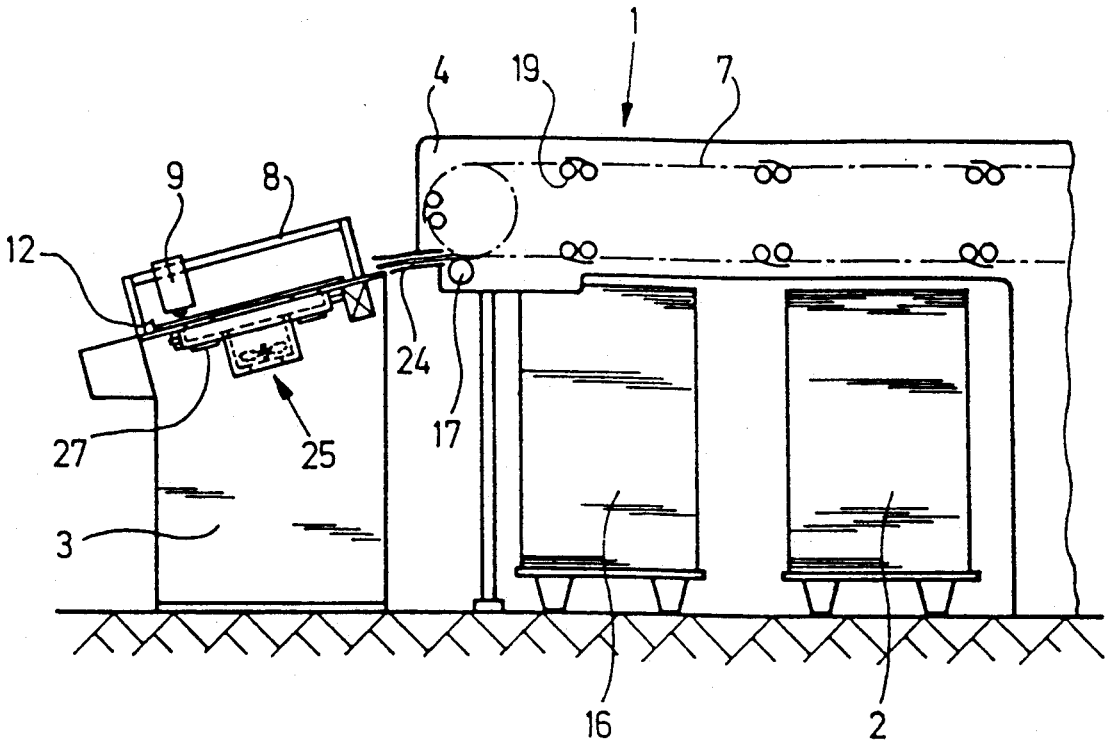
Fig. 6
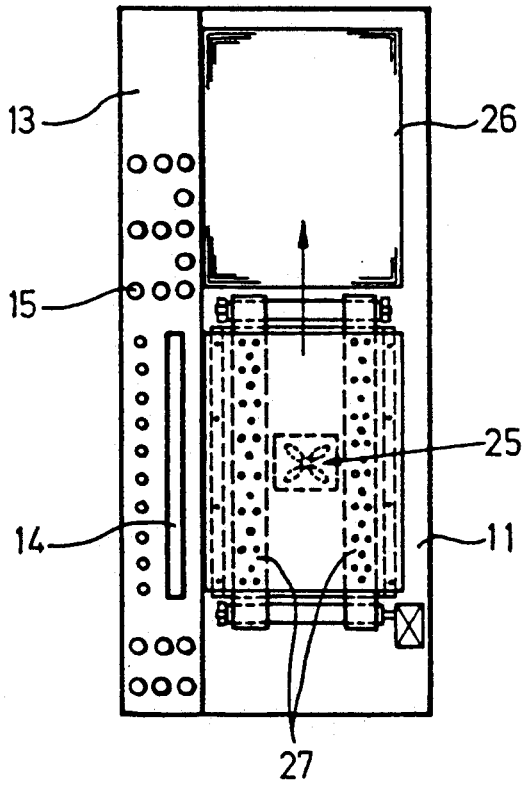
Fig. 7
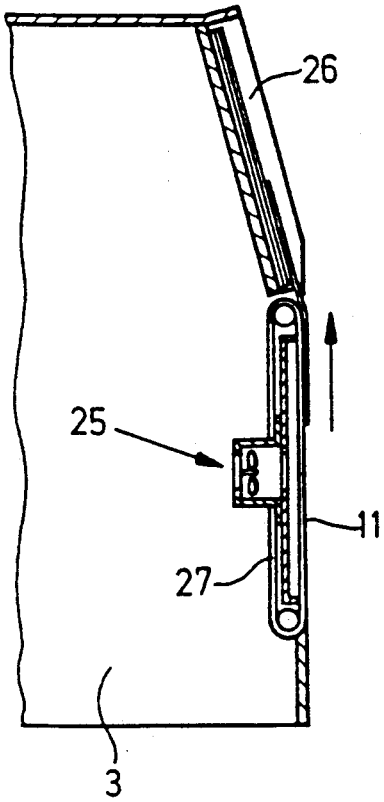

SHEET-FED OFFSET AND PRINTING MACHINE HAVING A CHAIN DELIVERY AND CONSOLE

This application is a continuation of application Ser. No. 215,216, filed July 5, 1988, now abandoned, which is a continuation-in-part of application Ser. No. 120,860, filed Nov. 16, 1987, now abandoned, which was a continuation-in-part of application Ser. No. 903,664, filed Sept. 1986, now abandoned.

The invention relates to a sheet-fed offset printing machine having a chain delivery and a control console.

A control console having at least a remote control device and optionally also a measuring device for quality control usually forms part of the equipment of a high-quality offset printing machine. Such a sheet-fed offset printing machine is known from German Published Non-Prosecuted Application (DE-OS) 27 28 738. The control console, an operating unit and a printer are arranged in immediate proximity of the chain delivery of this sheet-fed offset printing machine. The remote control device of the control console is arranged so as not to hinder the removal of a full sheet pile from the chain delivery in sheet-conveying direction. Every test sheet withdrawn from the chain delivery in this heretofore known construction must be conveyed each time manually in an involved and time-consuming manner to the table-top surface of the sheet deposit structure of the control console. Moreover, the arrangement of the control console at a given distance from the printing machine is cumbersome and wastes too much space.

It is furthermore known from Japanese Published Utility Model Application Sho 58-55941 to remove the delivery piles of a double-pile delivery laterally i.e. from a side of the chain delivery. At the end of the chain delivery, a sheet-catching table is provided apparently for receiving test sheets. The individually ejected test sheets must likewise also be withdrawn from this sheet-catching table and conveyed in an involved manner to the sheet deposit structure of a control console in order to be able to evaluate them.

It is accordingly an object of the invention to provide a sheet-fed offset printing machine having a chain delivery and a control console wherein the withdrawal of test sheets and the quality control of the sheets directly connected therewith are simplified.

With the foregoing and other objects in view, there is provided, in accordance with the invention a sheet-fed offset printing machine including a chain delivery and a control console assigned to the chain delivery and including a remote-control device and a sheet deposit structure for controlling quality of a freshly printed sheet during operation of the printing machine, the control console being capable of for effecting a test sheet withdrawal, the control console with the sheet deposit structure being arranged directly at an end of the chain delivery, as viewed in sheet travel direction, the sheet deposit structure being disposed below a sheet conveying path and a test-sheet outlet, respectively, as an extension of the chain delivery.

In accordance with other features of the invention, the withdrawal of the test sheets is fully automated i.e. the ejected test sheets do not have to be manually conveyed ar all. The control console is disposed at an end of the chain delivery compactly and in a space-saving manner. The downwardly declined table-top surface of the sheet deposit structure is adapted to the outlet of the test sheet. All operating, display or indicating, control, memory or storage, and printing control elements are disposed in the control console as well as those operating or actuating elements which are usually provided at the rear end of the chain delivery. It is also advantageous for the operator always to keep the printing machine under observation during the quality control, whereby both the test sheet deposit structure, as well as the zonewise operating elements of the control console remain assigned or associated exactly with the inking zones of the printing units. The printer or operator can thus react more rapidly to inking and dampening irregularities than if he had first to convey the test sheets to a remotely located control console. Rapid reaction to faulty adjustments becomes favorably noticeable especially during the start-up phase of the sheet-fed offset printing machine.

In accordance with additional features of the invention, the chain delivery is constructed so that the sheet piles are removable laterally therefrom, especially when a double sheet delivery is required for processing thick cardboard. If necessary, however, the control console is constructed so as to be either removable, upwardly liftable or pivotable away from the end of the chain delivery so that the sheet pile is removable in the sheet conveying or travel direction.

In accordance with added features of the invention, and in order to respond reliably and rapidly to the sheet deposit structure of the control console sheets which have been taken by a test sheet withdrawal device from the chain delivery, sheet-guiding elements are provided between the sheet deposit structure, on the one hand, and the chain delivery and the test sheet withdrawal device, respectively, on the other hand.

In accordance with a further feature of the invention, at least one of the sheet guiding elements is a suction roller disposed below the end of the chain delivery.

In accordance with a concomitant feature of the invention, the sheet deposit structure of the control console is formed with a table-top surface having a width which is double the width of a test sheet of maximum format.

Other features which are considered as characteristic for the invention are set forth in the appended claims.

Although the invention is illustrated and described herein as embodied in sheet-fed offset printing machine having a chain delivery and a console, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 5 is an elevational view of the sheet transport conveyor with the control console installed at the end of the conveyor.

FIG. 6 is a plan view of the control console showing the details of the sheet withdrawal elements.

FIG. 7 is an elevational part cross-sectional, diagrammatic, fragmentary view of the control console showing withdrawal of a sheet from the layoff table.

Figure 1:
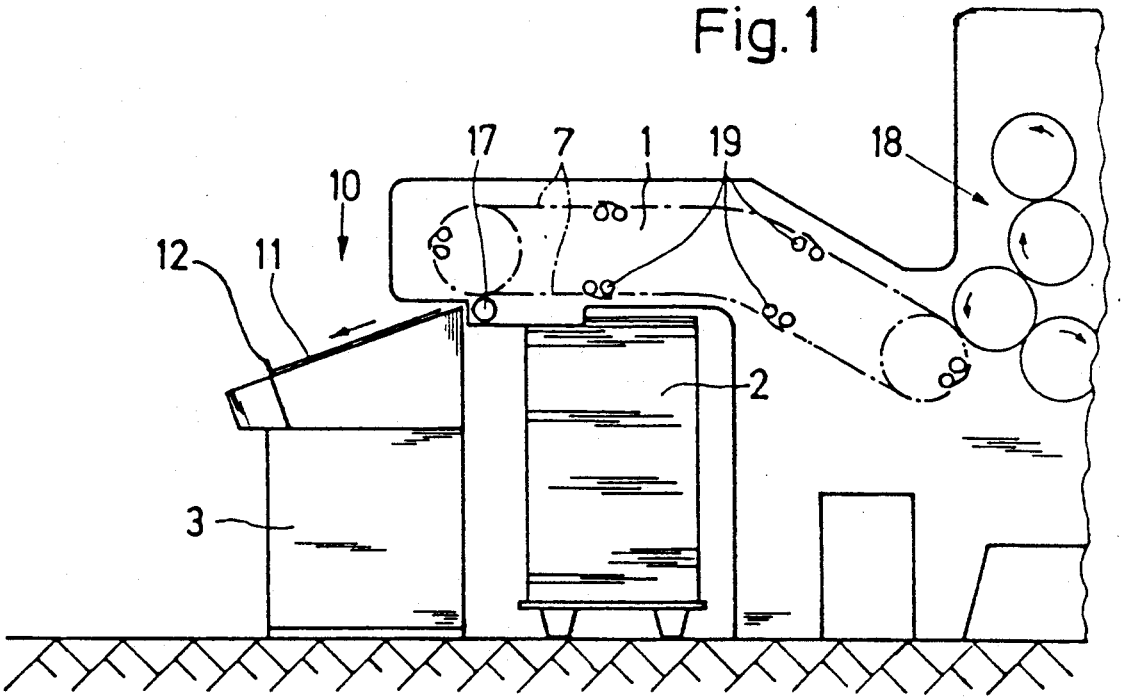
FIG. 1 is a diagrammatic side elevational view of a sheet delivery according to the invention which delivers a single pile of sheets.
Figure 2:
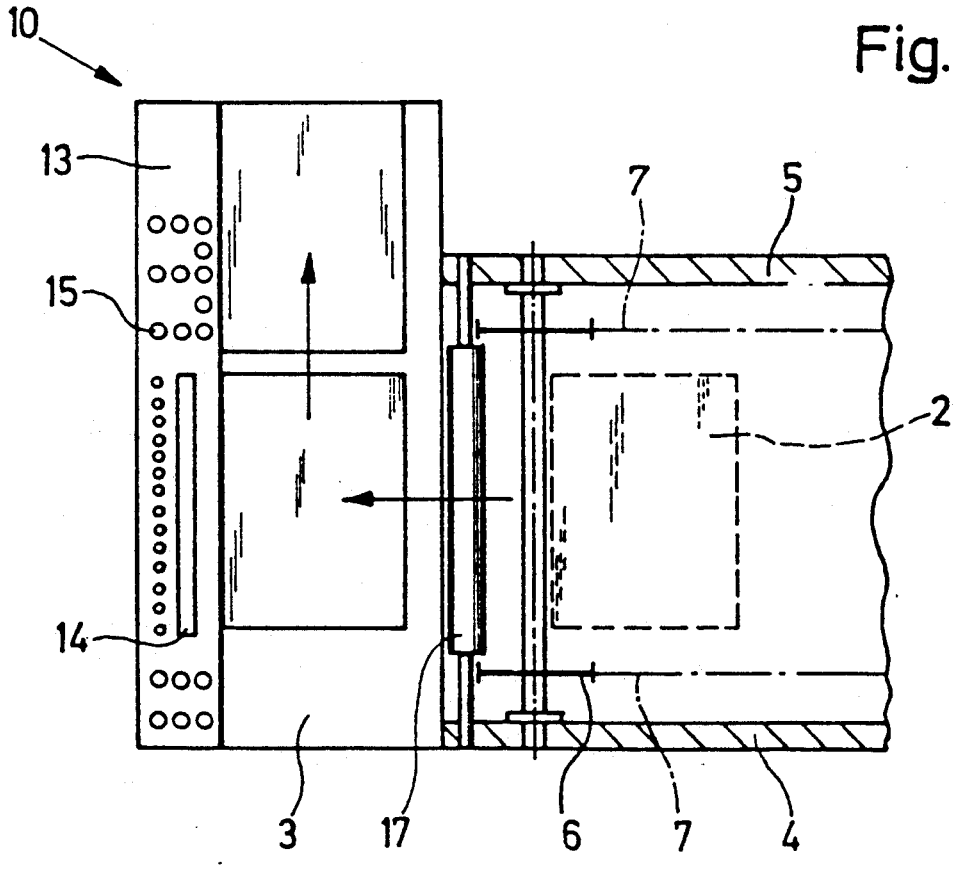
FIG. 2 is a top plan view of FIG. 1.
Figure 4:
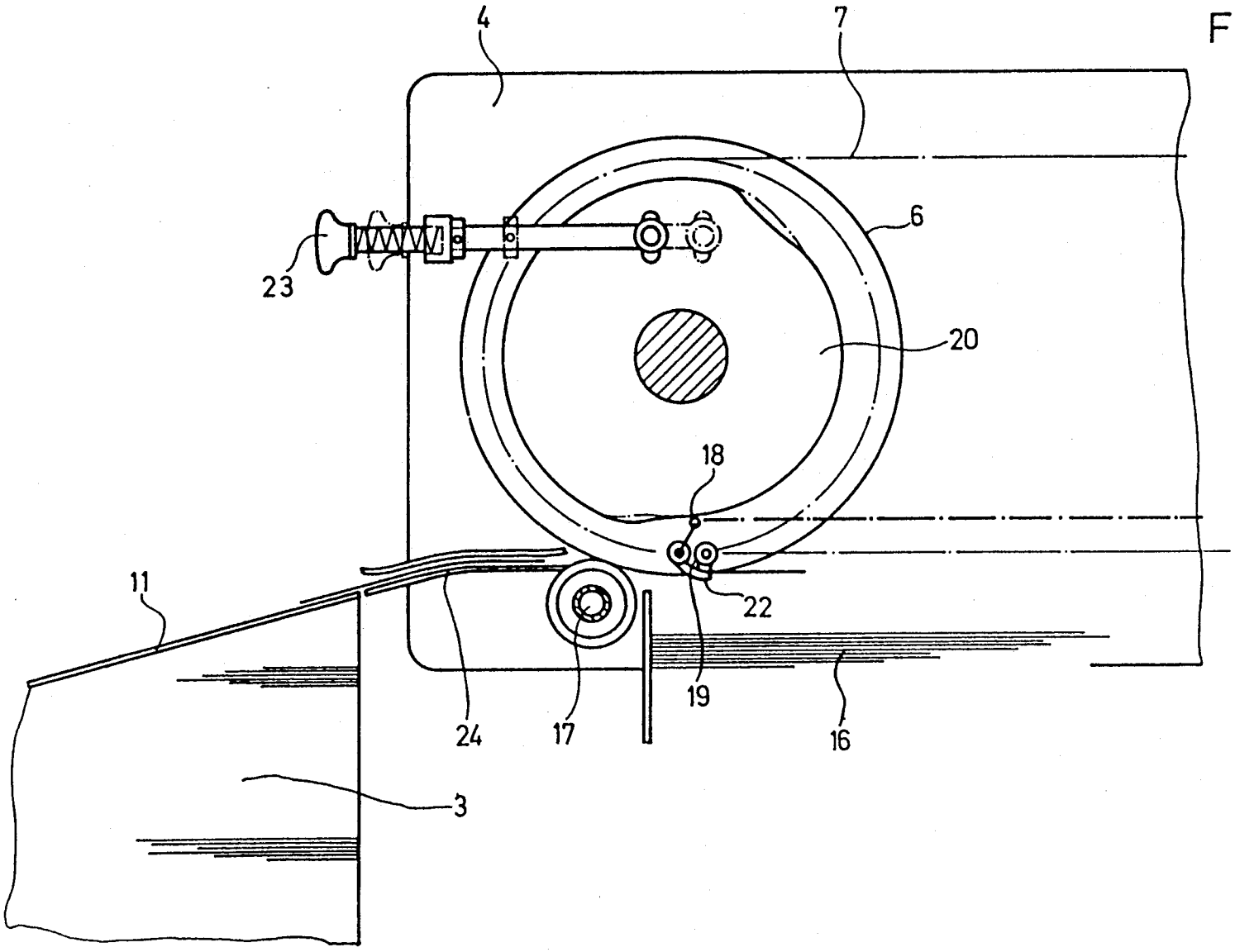
FIG. 4 is an enlarged elevational fragmentary view of a sheet withdrawal device.
Figure 11:
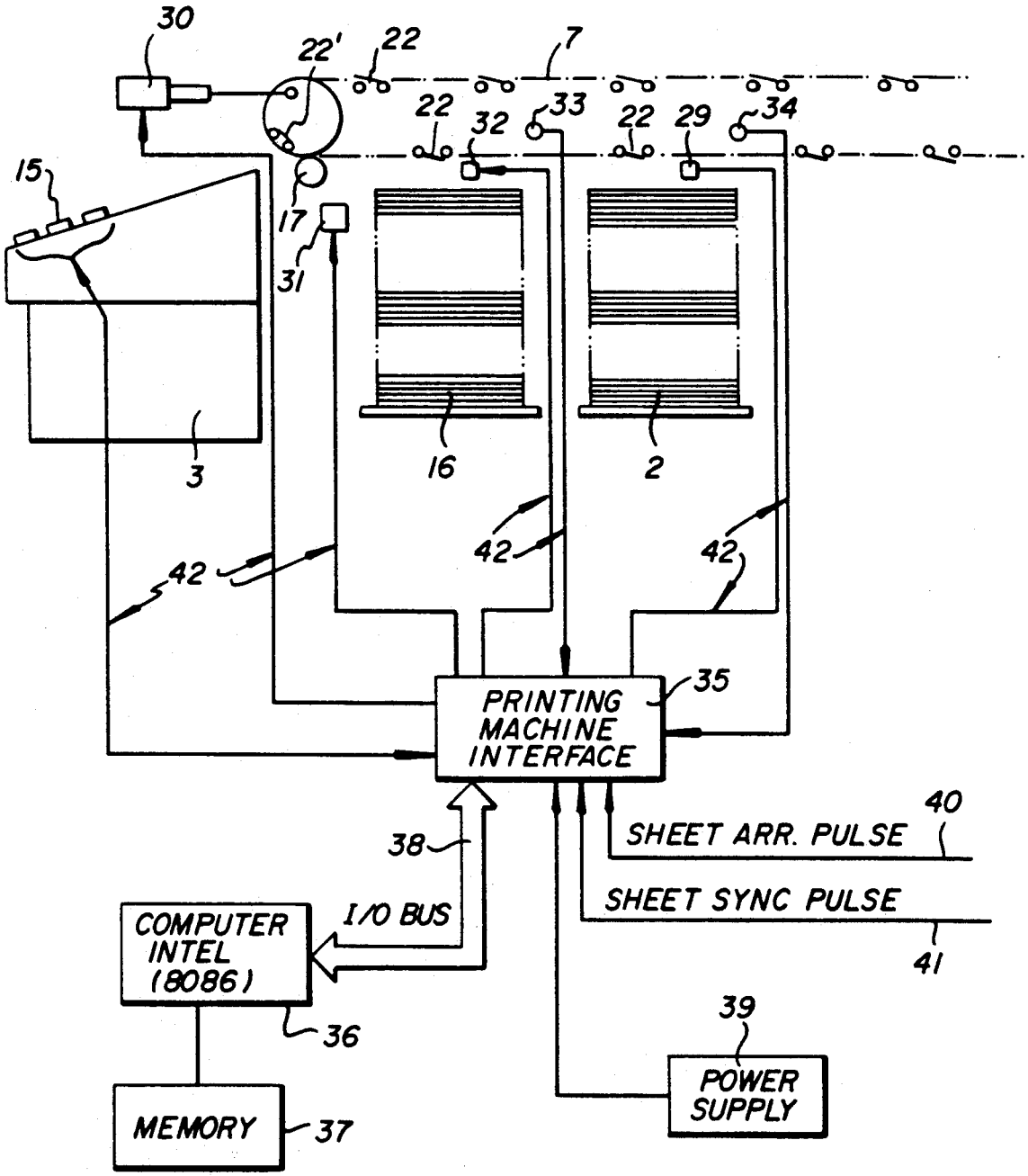
FIG. 11 is a block diagram of the stored program control elements, the printing machine and the interface circuits.

Referring now to the drawing and, first, particularly to FIGS. 1 and 2 thereof, there is diagrammatically shown therein a chain delivery 1 with a delivery pile 2 of sheets which can be drawn out to an operating or servicing side. Thus, the removal of a full delivery pile as well as the insertion of empty pile tables is effected from the operating side. A control console or desk 3 is attached to the chain delivery 1 at the end thereof. The control console 3 is firmly connected to side walls 4 and 5 of a sheet-fed rotary printing machine. A test sheet-withdrawal device 23, 30 is shown in FIGS. 4 and 11, is shown, for example in more detail, in German Utility Patent G 83 18 009.5, is provided in the side walls 4 and 5 and below sprocket wheels 6 of a delivery chain conveyor 7 of the delivery system 1. The control console 3 is provided with sheet deposit structure 10 having a rear-to-front downwardly declining table-top surface 11. The upper end of the surface 11 is located directly in front of an outlet for the test sheet. Towards the lower end of the surface 11 of the sheet deposit structure 10, a catching rail 12 is provided for limiting the surface 11 and for presenting an abutment for stopping by the leading edge of an oncoming test sheet.

All control and memory or storage elements necessary for controlling the printing machine are provided in the control console 3. An operating panel 13 of the control console 3 is equipped with a series of different types of operating keys and buttons 15 in addition to a display 14. The sheet deposit structure 10, as shown, may be of so-called double width in order to be able to deposit laterally the sheets which have already been checked with respect to their quality. Especially when of double-width construction. The control console 10 can also be provided with a display screen and can have a printing device for printing control strips, and a magnetic tape device. Moreover, it is possible to equip the sheet deposit structure 10 with a measuring device for ink density measurements and quality control. In such a case, a fully-automatic control of the sheet-fed rotary offset printing machine is preferred wherein every n'th sheet of the run to be printed is transported by means of the test sheet withdrawing device onto the table-top surface 11 of the sheet deposit structure 10 and then measured for ink density.

The ink density values form a basis for quality control and possibly for improved adjustment of the sheet-fed offset printing machine. After the quality control, the sheet lying on the table-top surface 11 is transported to a side of the sheet deposit surface by sheet transporting means 27 (FIGS. 6 and 7). The control console according to the invention, thus provides the capability of checking and controlling the sheet-fed offset printing machine with respect to inking and dampening, register adjustment and so forth.

Figure 3:
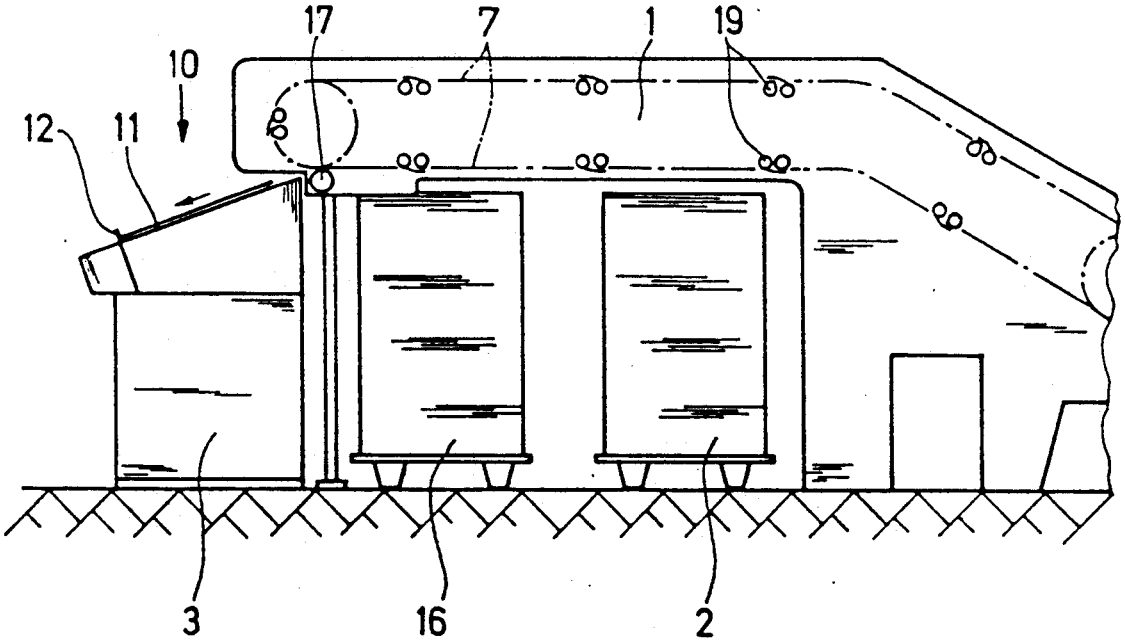
FIG. 3 is a view like that of FIG. 1 of another embodiment of the sheet delivery according to the invention which delivers a double pile of sheets.

The embodiment of FIG. 3 differs only slightly from that of FIG. 1. In this case, the chain delivery 1 is provided with two delivery piles 2 and 16 located one after the other. Both delivery piles 2 and 16 are removable from the operating side of the printing machine; while one pile is being formed by deposited sheets, the other pile can be pulled out for the purpose of removing it. A double pile delivery is performed especially when thick materials, such as cardboard, are to be processed because, in such a case, the maximum height is very quickly reached. The control console 3 is arranged and constructed in exactly the same way as in the embodiment according to FIG. 1. In high-speed printing machines, especially when processing cardboard, quick reaction to misadjustments or faulty settings is necessary. Precisely in such a case is the application of the device of the control console 3 of great utility.

The suction roller 17 transports the test sheets, which are fed by means of gripper bridges 19 from the last printing unit 18 to the conveyor chains 7 of the chain delivery 1, directly onto the table-top surface 11 of the sheet deposit structure 10. In the non-illustrated drive of the suction roller 17, a conventional delay transmission can be provided with which the speed of the suction roller 17 is greatly reduced in vicinity of the sheet end which is to be conveyed, in order to ensure a slow and smooth deposit of the sheet. The reduction in speed can alternatively be provided by means of an electric control of a separate drive motor not shown, in order to brake or slow the sheet down.

FIG. 4 shows substantially an enlarged detail of the sheet-withdrawal device. By operating the handle 23, a gripper-opening cam 20 is set such that the sheet delivered by the delivery chain conveyor 7 is placed either on the delivery pile 16, or by means of the suction roller 17 delivered to the sheet guide 24. In the latter case, the test sheet is placed on the table 11, whereby the suction roller 17 may cause a slow-down of the sheet.

FIGS. 5 and 7 show substantially how the control console 3, and especially how the sheet lay-off is arranged. Above the table 11 there are perforated suction transport bands 27 which are pulling sideways from the table 11, in direction transverse to the direction of flow of the arriving sheet. A suction device 25 causes the sheet to be drawn, with a moderate force, against the suction bands 27. The latter move the sheet to be evaluated transversely to the sheet direction to the lower lying side-mounted sheet lay-off 26. The side-mounted sheet lay-off 26 may contain approximately 200 sheets.

Figure 8:
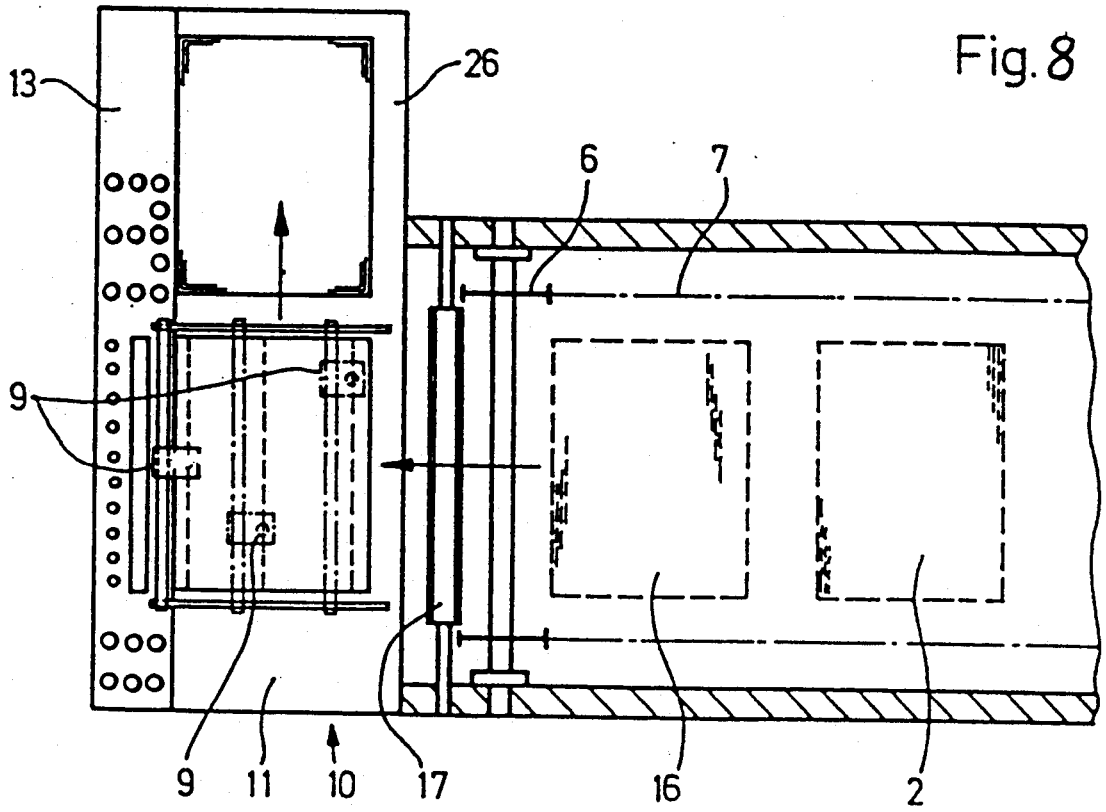
FIG. 8 is a plan view of the chain delivery and the control console arranged directly at the end of the chain delivery.
Figure 9:
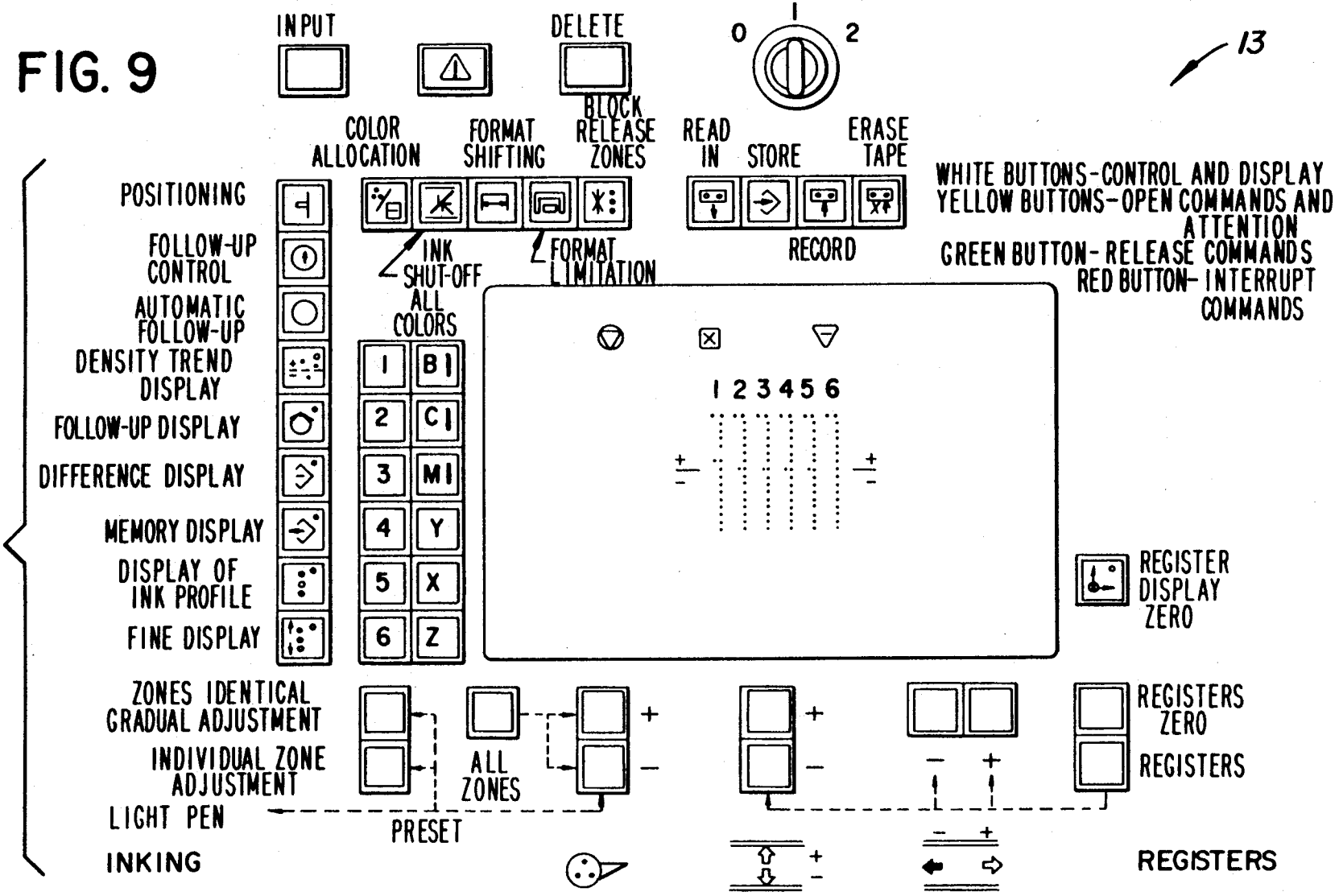
FIG. 9 is a plan view of the operating board of the control console showing the control and display elements for setting the parameters of the printing machine.

FIGS. 8 and 9 show especially how the measuring device 8 operates in well known manner to measure, for quality control purposes, the ink density by means of the measuring head 9. After the test sheet has been placed on the table 11, the measuring head is moved, in its most left hand position along the sheet edge, in direction transversely to the direction of the sheet movement, in order to scan a test stripe of the printed sheet for ink density and thereby measure the sheet quality. The measuring head 9 can, however, also be moved so that it can scan and measure any desired area of the printed image. The guiding of the sheet, the measuring process and the sideways removal of the measured sheet can be performed completely automatically, and there may be provided, for example, a counter that draws every five hundredth sheet, for example, onto the table 11, in order to test its print quality. A subsequent adjustment of the printing machine can then be performed completely automatically in accordance with the measurements from the console 3, known as the type CPC-I console.

FIG. 9 is an elevational view of the operating panel of the control console, showing the control elements for regulating, adjusting and operating the printing machine. The further details of this panel are not shown since the invention is not directed to the details of controlling ink feed, measuring of ink density and so forth which are well known arts of the printing industry.

Figure 10:
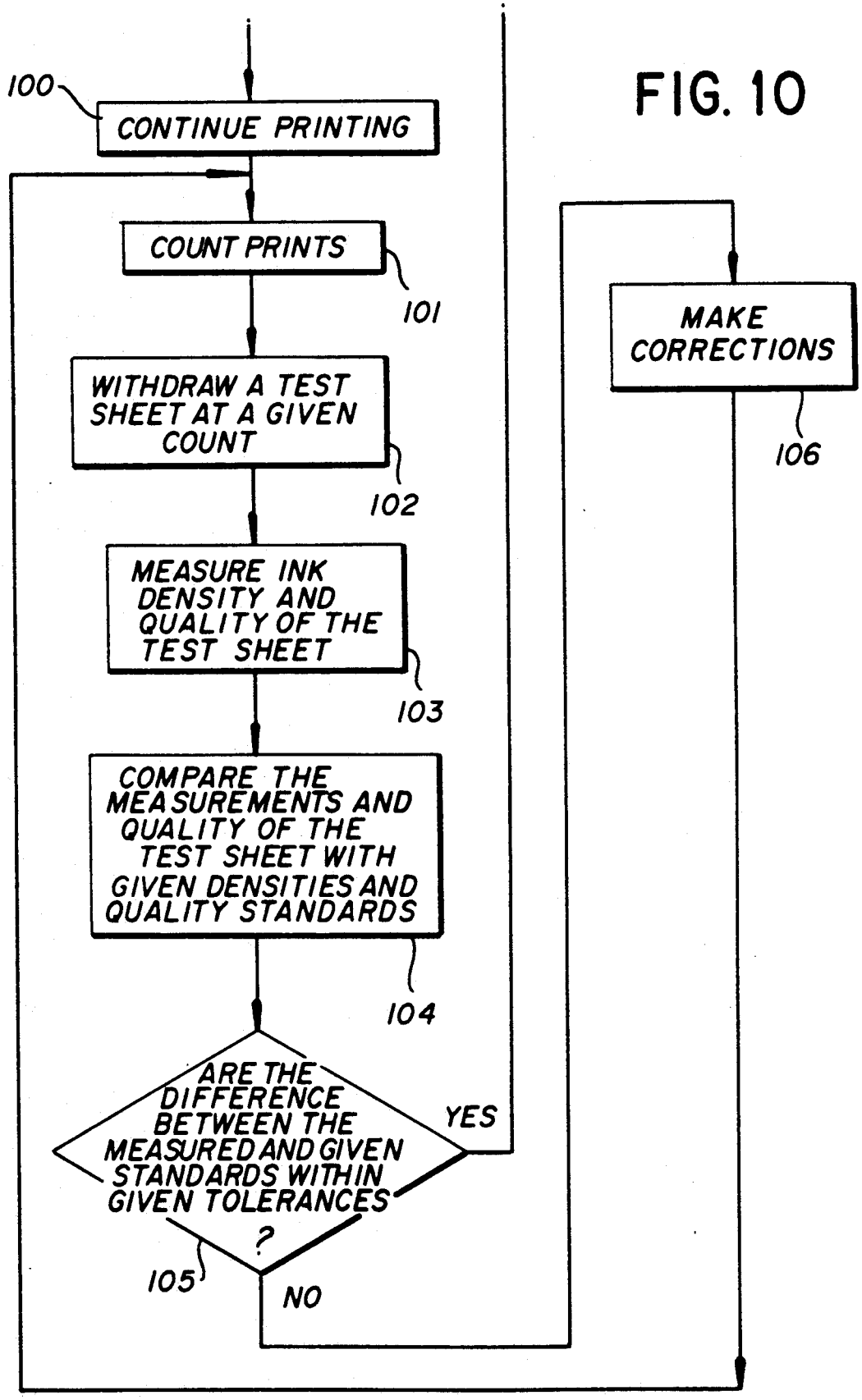
FIG. 10 is a flow chart showing the steps of the disclosed method.

FIG. 10 is a flow-chart of the steps of operating the machine according to the invention. In step 100 the machine is producing prints. In step 101 each print produced is counted. In step 103, at a given count, a test sheet is withdrawn from the machine and has ink densities measured and inspected for quality. In step 104 the measured values are compared with given ink density and quality standards. In decision step 105 it is determined if the ink density values and quality are within the range of given acceptable tolerances. If the answer is YES, the printing continues in step 100; is the answer is NO, corrections are made at the control desk. In step 106 the printing continues in step 100.

FIG. 11 is a block diagram showing the electronic control of the invention. A computer 36, advantageously of type Intel 8086, has a memory 37 for storing control programs and data. A printing machine interface 35 is connected by an input-output bus 38 to the computer and by control leads 42 to the individual machine elements, which include a test sheet release solenoid 30, which, in the computer-controlled embodiment of the machine replaces the operating handle 23. A suction control valve 31 controls vacuum to the suction roller 17. Sheet grippers 22 are controlled by gripper magnets 32 and 29, respectively associated with sheet piles or stacks 16 and 2, and serve to release a gripper 22 when the sheet, held by its leading edge in the gripper, is in position above a respective stack 16, 2. Photocells 33, 34 respectively associated with stacks 16 and 2 serve to monitor the actual arrival of a sheet at the respective stacks 16, 2. Control keys 15 on the face of console 3 enable the machine operator to instruct the machine to drop a sheet on either pile or stack 16 or 2 or to eject a sheet onto the console 3. In the latter case none of the grippers 22 is released, but vacuum is connected to the suction roller 17 by a suction control valve 31, and the solenoid 30 is operated, which sets the cam 20 such that the gripper 22' is released, allowing a sheet to be delivered to the table top 11 of the console 3, for further processing and measuring as described above under the manual operation. In order to inform the printing machine interface 35 and the computer 36 of the anticipated arrival of a sheet, a sheet arrival pulse is received on lead 40 form the general printing machine control system which is not shown. A sheet synchronization pulse is received on lead 41.

What is claimed is:

1. Sheet-fed offset printing machine comprising a chain delivery for delivering printed sheets to at least one sheet pile, a control console assigned to said chain delivery, sheet withdrawal means including a test sheet outlet for withdrawing a test sheet from the chain delivery disposed proximal to said control console, a sheet deposit structure and machine control means for controlling quality of a freshly printed sheet during operation of the printing machine disposed on said control console, said machine control means including a measuring device for measuring the quality of said sheet, said chain delivery having an extension, said control console with said sheet deposit structure disposed at an end of said chain delivery extension, as viewed in sheet travel direction, said sheet deposit structure disposed below said, test sheet outlet, and sheet guiding means disposed between said test sheet outlet and said sheet-deposit structure.

2. Sheet-fed offset printing machine according to claim 1, wherein said chain delivery includes means for lateral removal of said sheet pile.

3. Sheet-fed offset printing machine according to claim 1, including means for moving said control console away from said end of said chain delivery.

4. Sheet-fed offset printing machine according to claim 3, wherein said control console is detachable from said chain delivery end by said moving means.

5. Sheet-fed offset printing machine according to claim 1, wherein said sheet guiding means include sheet guiding elements located between said sheet deposit structure of said control console and one of said chain delivery and a test-sheet withdrawal means.

6. Sheet-fed offset printing machine according to claim 5, including sheet-gripping means disposed between said test-sheet withdrawal means and said sheet deposit structure for automatically gripping a test sheet withdrawn from said chain delivery and depositing it on said sheet deposit structure of said control console.

7. Sheet-fed offset printing machine according to claim 5, including a suction roller disposed below said end of said chain delivery.

8. Sheet-fed offset printing machine according to claim 1, wherein said sheet deposit structure of said control console includes a table-top surface having a width which is double the width of a test sheet of maximum format.

9. Sheet-fed offset printing machine according to claim 7, wherein said sheet deposit structure has sheet holding means for holding a plurality of sheets in a position wherein they are lying above one another, and including delay means disposed in vicinity of said sheet holding means and means for delaying the speed of rotation of said suction roller.

10. Sheet-fed offset printing machine according to claim 9, wherein said delaying means include a separate drive motor.

11. Sheet-fed offset printing machine according to claim 10, including control circuitry for said separate drive motor.

12. Sheet-fed printing machine according to claim 1, including a sheet counter for counting sheets delivered to said sheet pile, said counter having an output connected to said test sheet withdrawal means for withdrawing a test sheet at a given count of said counter.

* * * * *